US008151587B2

(12) United States Patent
Chiang et al.

(10) Patent No.: US 8,151,587 B2
(45) **Date of Patent: *Apr. 10, 2012**

(54) MEDIUM TEMPERATURE REFRIGERATED MERCHANDISER

(75) Inventors: Robert Hong Leung Chiang, Manlius, NY (US); Eugene Duane Daddis, Jr., Manlius, NY (US); Kwok Kwong Fung, Granger, IN (US); Sue-Li Kingsley Chuang, Manlius, NY (US)

(73) Assignee: Hill Phoenix, Inc., Conyers, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/736,487

(22) Filed: Dec. 15, 2003

(65) Prior Publication Data

US 2004/0123613 A1 Jul. 1, 2004

Related U.S. Application Data

(63) Continuation of application No. 09/849,209, filed on May 4, 2001, now Pat. No. 6,679,080.

(51) Int. Cl.
*A47F 3/04* (2006.01)

(52) U.S. Cl. ..... 62/246; 62/256

(58) Field of Classification Search ..... 62/255, 62/256, 515, 246; 165/150, 151, 152, 153
See application file for complete search history.

(56) References Cited

U.S. PATENT DOCUMENTS

| | | | | |
|---|---|---|---|---|
| 2,200,502 A | | 5/1940 | Johnson | |
| 2,384,313 A | | 9/1945 | Kohler | |
| 2,462,240 A | * | 2/1949 | Van Vliet et. al. | 62/198 |
| 2,715,321 A | | 8/1955 | Burger | |
| 2,912,834 A | | 11/1959 | Mann | |
| 2,986,901 A | | 6/1961 | Hubacker | |
| 2,991,048 A | | 7/1961 | Rabin | |
| 3,012,760 A | | 12/1961 | McGrath | |
| 3,267,692 A | | 8/1966 | Pfeiffer et al. | |
| 3,577,744 A | | 5/1971 | Mercer | |
| 3,681,896 A | | 8/1972 | Velkoff | |
| 3,741,242 A | * | 6/1973 | Hansen et al. | 137/504 |
| 3,788,089 A | * | 1/1974 | Graves | 62/137 |
| 3,800,551 A | | 4/1974 | Weibel, Jr. et al. | |

(Continued)

FOREIGN PATENT DOCUMENTS

EP 0727626 A1 * 8/1996

(Continued)

OTHER PUBLICATIONS

European Search Report for Application No. EP 02 25 2948, date of completion of search Jul. 22, 2004, 2 pages.

*Primary Examiner* — Mohammad Ali
(74) *Attorney, Agent, or Firm* — Foley & Lardner LLP

(57) ABSTRACT

A refrigerated merchandiser (100) includes an upright, open-front, insulated cabinet (110) defining a product display area (125) connected in airflow communication with a compartment (120) via an air circulation circuit (122, 114, 116). A high pressure drop evaporator (40) and a plurality of closely spaced fans (70) are disposed within compartment (120). The evaporator (40) is provided with a relatively high fin density heat exchanger coil providing a relatively high air side pressure drop through the evaporator. The increased flow resistance through the evaporator coupled with the plurality of closely spaced fans results in a substantially uniform evaporator outlet temperature profile across the length of the evaporator.

10 Claims, 5 Drawing Sheets

U.S. PATENT DOCUMENTS

| | | | | | |
|---|---|---|---|---|---|
| 3,804,159 | A | * | 4/1974 | Searight et al. | 165/109.1 |
| 4,272,969 | A | | 6/1981 | Schwitzgebel et al. | |
| 4,326,390 | A | * | 4/1982 | Brooks | 62/382 |
| 4,434,843 | A | | 3/1984 | Alford | |
| 4,569,390 | A | | 2/1986 | Knowlton et al. | |
| 4,644,758 | A | | 2/1987 | Maehara et al. | |
| 5,022,149 | A | * | 6/1991 | Abbott | 29/890.048 |
| 5,157,941 | A | * | 10/1992 | Cur et al. | 62/441 |
| 5,179,845 | A | | 1/1993 | Sasaki et al. | |
| 5,214,847 | A | * | 6/1993 | Aoki | 29/890.043 |
| 5,228,197 | A | * | 7/1993 | Cox et al. | 29/890.035 |
| 5,357,767 | A | * | 10/1994 | Roberts | 62/256 |
| 5,502,979 | A | * | 4/1996 | Renard | 62/256 |
| 5,682,944 | A | | 11/1997 | Yamamoto et al. | |
| 5,743,098 | A | | 4/1998 | Behr | |
| 5,755,108 | A | | 5/1998 | Ibrahim et al. | |
| 5,799,728 | A | | 9/1998 | Blume | |
| 5,816,053 | A | * | 10/1998 | Huether | 62/65 |
| 5,832,995 | A | | 11/1998 | Chiang et al. | |
| 5,974,818 | A | | 11/1999 | Topper et al. | |
| 6,076,368 | A | | 6/2000 | Noble | |
| 6,102,107 | A | | 8/2000 | Dunne | |
| 6,145,327 | A | * | 11/2000 | Navarro | 62/89 |
| 6,167,619 | B1 | | 1/2001 | Beagle | |
| 6,237,350 | B1 | | 5/2001 | Hertel et al. | |
| 6,308,527 | B1 | | 10/2001 | Kuroyanagi et al. | |
| 6,378,605 | B1 | * | 4/2002 | Kutscher et al. | 165/181 |
| 6,679,080 | B2 | | 1/2004 | Chiang et al. | |
| 6,923,013 | B2 | | 8/2005 | Chiang et al. | |
| 2001/0019120 | A1 | * | 9/2001 | Schnur et al. | 252/68 |

FOREIGN PATENT DOCUMENTS

| | | | |
|---|---|---|---|
| EP | 1316119 | | 6/2003 |
| JP | 7189684 | | 7/1995 |
| JP | 7-318276 | A * | 12/1995 |
| JP | 8303933 | | 11/1996 |
| JP | 10148441 | | 6/1998 |
| JP | 410185413 | | 7/1998 |

* cited by examiner

MEDIUM TEMPERATURE REFRIGERATED MERCHANDISER

This application is a continuation of, commonly assigned, U.S. patent application Ser. No. 09/849,209, filed May 4, 2001 now U.S. Pat. No. 6,679,080.

TECHNICAL FIELD

The present invention relates generally to refrigerated merchandiser systems and, more particularly, to a refrigerated, medium temperature, merchandiser system for displaying food and/or beverage products.

BACKGROUND OF THE INVENTION

In conventional practice, supermarkets and convenient stores are equipped with display cases, which may be open or provided with doors, for presenting fresh food or beverages to customers, while maintaining the fresh food and beverages in a refrigerated environment. Typically, cold, moisture-bearing air is provided to the product display zone of each display case by passing air over the heat exchange surface of an evaporator coil disposed within the display case in a region separate from the product display zone so that the evaporator is out of customer view. A suitable refrigerant, such as for example R-404A refrigerant, is passed through the heat exchange tubes of the evaporator coil. As the refrigerant evaporates within the evaporator coil, heat is absorbed from the air passing over the evaporator so as to lower the temperature of the air.

A refrigeration system is installed in the supermarket and convenient store to provide refrigerant at the proper condition to the evaporator coils of the display cases within the facility. All refrigeration systems include at least the following components: a compressor, a condenser, at least one evaporator associated with a display case, a thermostatic expansion valve, and appropriate refrigerant lines connecting these devices in a closed circulation circuit. The thermostatic expansion valve is disposed in the refrigerant line upstream with respect to refrigerant flow of the inlet to the evaporator for expanding liquid refrigerant. The expansion valve functions to meter and expand the liquid refrigerant to a desired lower pressure, selected for the particular refrigerant, prior to entering the evaporator. As a result of this expansion, the temperature of the liquid refrigerant also drops significantly. The low pressure, low temperature liquid evaporates as it absorbs heat in passing through the evaporator tubes from the air passing over the surface of the evaporator. Typically, supermarket and grocery store refrigeration systems include multiple evaporators disposed in multiple display cases, an assembly of a plurality of compressors, termed a compressor rack, and one or more condensers.

Additionally, in certain refrigeration systems, an evaporator pressure regulator (EPR) valve is disposed in the refrigerant line at the outlet of the evaporator. The EPR valve functions to maintain the pressure within the evaporator above a predetermined pressure set point for the particular refrigerant being used. In refrigeration systems used to chill water, it is known to set the EPR valve so as to maintain the refrigerant within the evaporator above the freezing point of water. For example, in a water chilling refrigeration system using R-12 as refrigerant, the EPR valve may be set at a pressure set point of 32 psig (pounds per square inch, gage) which equates to a refrigerant temperature of 34 degrees F.

In conventional practice, evaporators in refrigerated food display systems generally operate with refrigerant temperatures below the frost point of water. Thus, frost will form on the evaporators during operation as moisture in the cooling air passing over the evaporator surface comes in contact with the evaporator surface. In medium-temperature refrigeration display cases, such as those commonly used for displaying produce, milk and other dairy products, or beverages in general, the refrigerated product must be maintained at a temperature typically in the range of 32 to 41 degrees F. depending upon the particular refrigerated product. In medium temperature produce display cases for example, conventional practice in the field of commercial refrigeration has been to pass the circulating cooling air over the tubes of an evaporator in which refrigerant passing through the tubes boils at about 21 degrees F. to maintain the cooling air temperature at about 31 or 32 degrees F. In medium temperature dairy product display cases for example, conventional practice in the commercial refrigeration field has been to pass the circulating cooling air over the tubes of an evaporator in which refrigerant passing through the tubes boils at about 21 degrees F. to maintain the cooling air temperature at about 28 or 29 degrees F. At these refrigerant temperatures, the outside surface of the tube wall will be at a temperature below the frost point. As frost builds up on the evaporator surface, the performance of the evaporator deteriorates and the free flow of air through the evaporator becomes restricted and in extreme cases halted.

Fin and tube heat exchanger coils of the type having simple flat fins mounted on refrigerant tubes that are commonly used as evaporators in the commercial refrigeration industry characteristically have a low fin density, typically having from 2 to 4 fins per inch. Customarily, in medium temperature display cases, an evaporator and a plurality of axial flow fans are provided in a forced air arrangement for supplying refrigerated air to the product area of the display case. Most commonly, the fans are disposed upstream with respect to air flow, that is in a forced draft mode, of the evaporator in a compartment beneath the product display area, with there being one fan per four-foot length of merchandiser. That is, in a four-foot long merchandiser, there would typically be one fan, in an eight-foot long merchandiser there would be two fans, and in a twelve-foot long merchandiser there would be three fans. In operation, the fan forces the air through the evaporators, passing over the tubes of the fin and tube exchanger coil, and circulates the refrigerated air through a flow duct on the backside of the merchandiser housing and thence through a flow duct at the top of the merchandiser housing to exit into the product display area. In open-front display case configurations, the refrigerated air exiting the upper flow duct passes generally downwardly across the front of the product display area to form an air curtain separating the product display area from the ambient environment of the store, thereby reducing infiltration of ambient air into the product display area.

As previously noted, it has been conventional practice in the commercial refrigeration industry to use only heat exchangers of low fin density in evaporators for medium temperature applications. This practice arises in anticipation of the buildup of frost of the surface of the evaporator heat exchanger and the desire to extend the period between required defrosting operations. As frost builds up, the effective flow space for air to pass between neighboring fins becomes progressively less and less until, in the extreme, the space is bridged with frost. As a consequence of frost buildup, heat exchanger performance decreases and the flow of adequately refrigerated air to the product display area decreases, thus necessitating activation of the defrost cycle. Additionally, since the pressure drop through a low fin density evaporator coil is relatively low, such a low pressure drop in combination with a relatively wide spacing between fans as mentioned hereinbefore, results in a significant variance in air velocity through the evaporator coil which in turn results in an undesirable variance, over the length of the evaporator coil, in the temperature of the air leaving the coil. Temperature variances of as high as 6° F. over a span as small as eight inches, are not a typical. Such stratification in refrigeration air temperature can potentially have a large effect on product temperature resulting in undesirable variation in product temperature within the product display area.

When frost forms on the evaporator coil, it tends to accumulate in areas where there is low airflow velocity to begin with. As a result, airflow is further maldistributed and temperature distribution becomes more distorted. Air flow distribution through the evaporator is also distorted as a result of the inherent air flow velocity profile produced by a plurality of conventionally spaced axial flow fans. As each fan produces a bell-curve like velocity flow, the air flow velocity profile is characteristically a wave pattern, with air flow velocity peaking near the centerline of each fan and dipping to a minimum between neighboring fans.

U.S. Pat. No. 5,743,098, Behr, discloses a refrigerated food merchandiser having a modular air cooling and circulating means comprising a plurality of modular evaporator coil sections of a predetermined length, each evaporator coil section having a separate air moving means associated therewith. The evaporator coils are arranged in horizontal, spaced, end-to-end disposition in a compartment beneath the product display area of the merchandiser. A separate pair of axial flow fans is associated with each evaporator section for circulating air from an associated zone of the product display zone through the evaporator coil for cooling, and thence back to the associated zone of the product display area.

SUMMARY OF THE INVENTION

It is an object of this invention to provide an improved medium temperature merchandiser having an improved air flow distribution through the evaporator.

It is a further object of this invention to provide a refrigerated merchandiser having an evaporator characterized by a relatively more uniform exit air temperature across the length of the evaporator.

A refrigerated merchandiser is provided having an insulated cabinet defining a product display area and a compartment separate from the product display area wherein an evaporator and at least one air circulator, advantageously a plurality of laterally spaced, air circulating axial flow fans, are disposed. In accordance with the present invention, the evaporator is characterized by a relatively high air side pressure drop. The evaporator may be a fin and tube heat exchanger having a fin density of at least 6 fins per inch. Most advantageously, the evaporator is a fin and tube heat exchanger having a fin density in the range of 6 fins per inch to 15 fins per inch. Further, the fins may have an enhanced heat transfer configuration. Additionally, the axial fans may be more closely spaced to accommodate a greater number of fans along the length of the evaporator. Most advantageously, the fans are spaced at intervals of about 2 feet or less. In an embodiment, the evaporator is disposed in a draw through flow arrangement with respect to the air circulator.

DESCRIPTION OF THE DRAWINGS

For a further understanding of the present invention, reference should be made to the following detailed description of a preferred embodiment of the invention taken in conjunction with the accompanying drawings wherein.

DESCRIPTION OF THE PREFERRED EMBODIMENT

Figure 1:
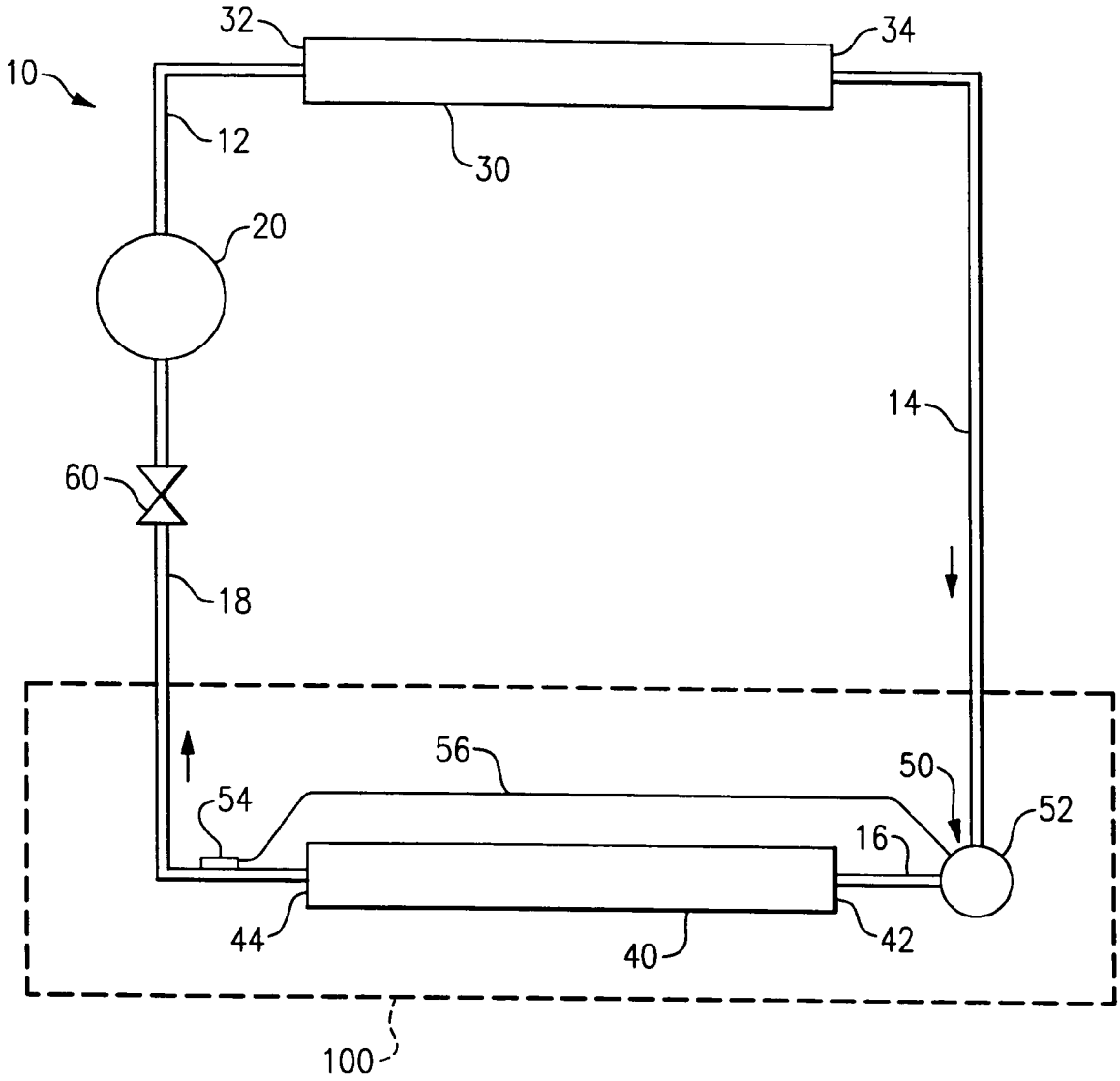
FIG. 1 is a schematic diagram of a commercial refrigeration system having a medium temperature food merchandiser.
Figure 2:
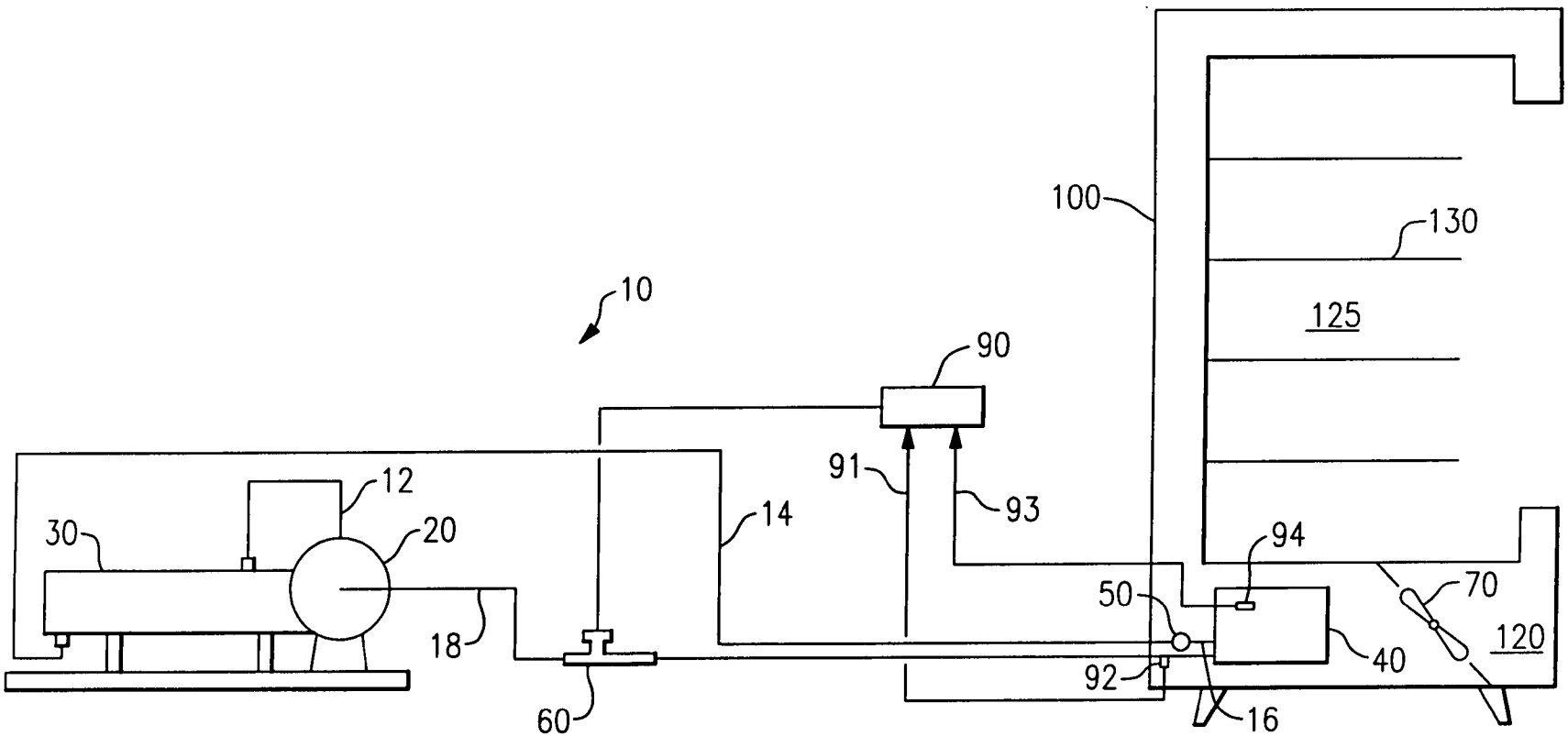
FIG. 2 is an elevation view of a representative layout of the commercial refrigeration system shown schematically in FIG. 1.

The refrigeration system is illustrated in FIGS. 1 and 2 is depicted as having a single evaporator associated with a refrigerated merchandiser, a single condenser, and a single compressor. It is to be understood that the refrigerated merchandiser of the present invention may be used in various embodiments of commercial refrigeration systems having single or multiple merchandisers, with one or more evaporators per merchandiser, single or multiple condensers and/or single or multiple compressor arrangements.

Referring now to FIGS. 1 and 2, the refrigerated merchandiser system 10 includes five basic components: a compressor 20, a condenser 30, an evaporator 40 associated with a refrigerated merchandiser 100, an expansion device 50 and an evaporator pressure control device 60 connected in a closed refrigerant circuit via refrigerant lines 12, 14, 16 and 18. Additionally, the system 10 includes a controller 90. It is to be understood, however, that the refrigeration system may include additional components, controls and accessories. The outlet or high pressure side of the compressor 20 connects via refrigerant line 12 to the inlet 32 of the condenser 30. The outlet 34 of the condenser 30 connects via refrigerant line 14 to the inlet of the expansion device 50. The outlet of the expansion device 50 connects via refrigerant line 16 to the inlet 41 of the evaporator 40 disposed within the display case 100. The outlet 43 of the evaporator 40 connects via refrigerant line 18, commonly referred to as the suction line, back to the suction or low pressure side of the compressor 20.

The refrigerated merchandiser 100, commonly referred to as a display case, includes an upright, open-front, insulated cabinet 110 defining a product display area 125. The evaporator 40, which is a fin and tube heat exchanger coil, is disposed within the refrigerated merchandiser 100 in a compartment 120 separate from and, in the depicted embodiment, beneath the product display area 125. The compartment 120 may, however, be disposed above or behind the product display area as desired. As in convention practice, air is circulated by air circulation means 70, disposed in the compartment 120, through the air flow passages 112, 114 and 116 formed in the walls of the cabinet 110 into the product display area 125 to maintain products stored on the shelves 130 in the product display area 125 at a desired temperature. A portion of the refrigerated air passes out the airflow passage 116 generally downwardly across the front of the display area 125 thereby forming an air curtain between the refrigerated product display area 125 and the ambient temperature in the region of the store near the display case 100.

The expansion device 50, which is generally located within the display case 100 close to the evaporator 40, but may be mounted at any location in the refrigerant line 14, serves to meter the correct amount of liquid refrigerant flow into the evaporator 40. As in conventional practice, the evaporator 40 functions most efficiently when as full of liquid refrigerant as possible without passing liquid refrigerant out of the evaporator into suction line 18. Although any particular form of conventional expansion device may be used, the expansion device 50 most advantageously comprises a thermostatic expansion valve (TXV) 52 having a thermal sensing element, such as a sensing bulb 54 mounted in thermal contact with suction line 18 downstream of the outlet 44 of the evaporator 40. The sensing bulb 54 connects back to the thermostatic expansion valve 52 through a conventional capillary line 56.

The evaporator pressure control device 60, which may comprise a stepper motor controlled suction pressure regulator or any conventional evaporator pressure regulator valve (collectively EPRV), operates to maintain the pressure in the evaporator at a preselected desired operating pressure by modulating the flow of refrigerant leaving the evaporator through the suction line 18. By maintaining the operating pressure in the evaporator at that desired pressure, the temperature of the refrigerant expanding from a liquid to a vapor within the evaporator 40 will be maintained at a specific temperature associated with the particular refrigerant passing through the evaporator.

Figure 3:
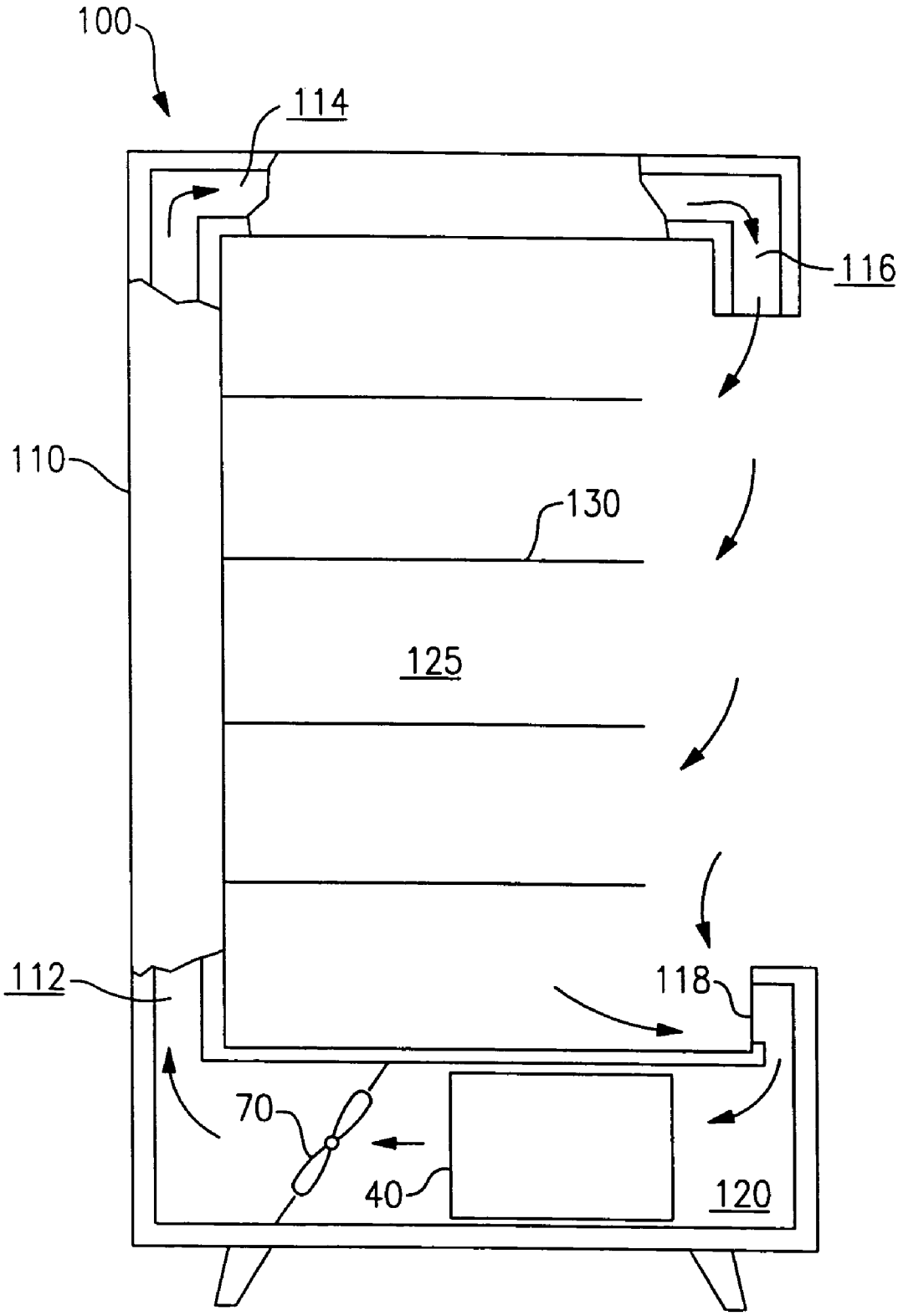
FIG. 3 is a side elevation view partly in section, of a preferred embodiment of the refrigerated merchandiser of the present invention.
Figure 4:
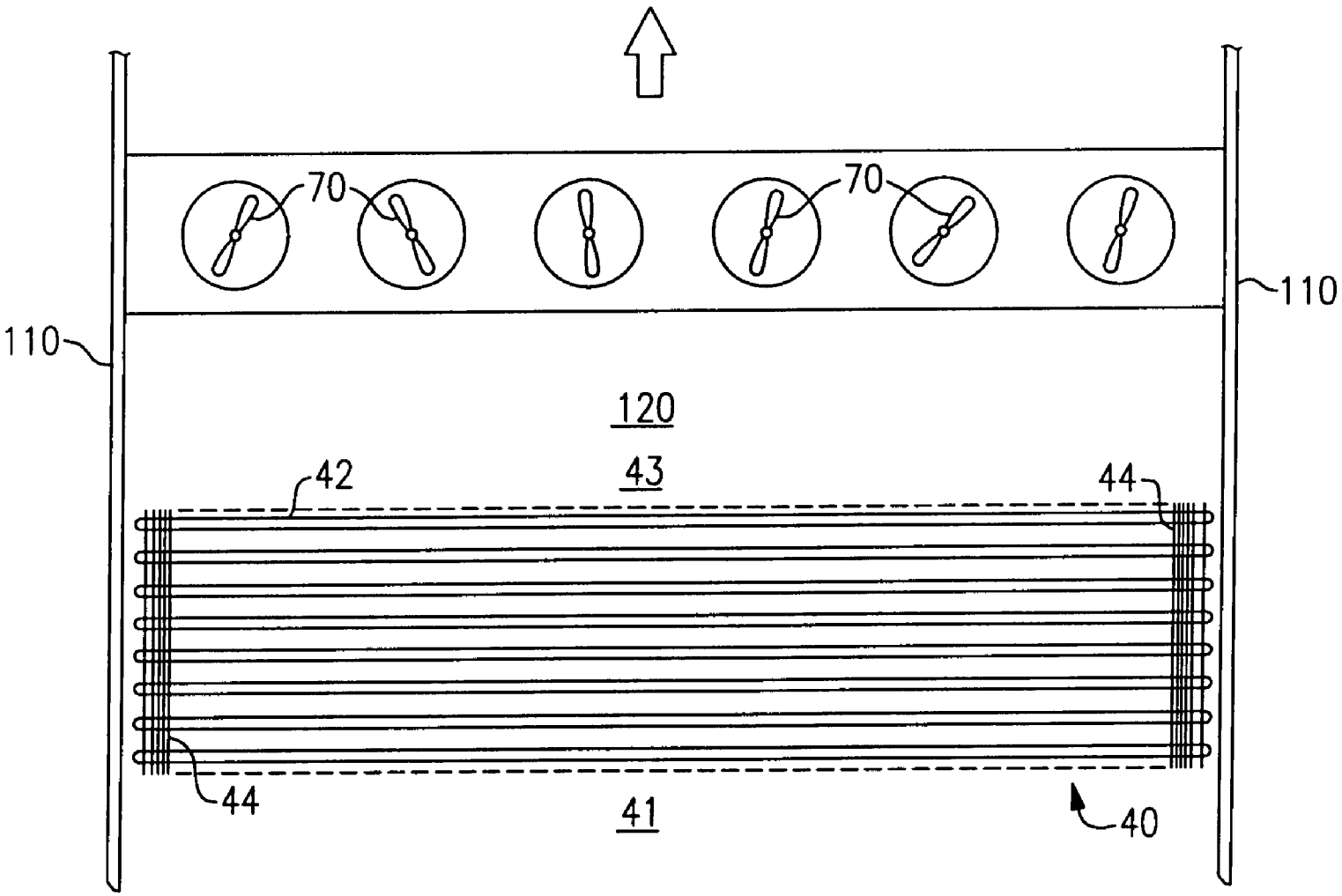
FIG. 4 is a plan view taken along line 4-4 of FIG. 3.

Referring now to FIGS. 3 and 4, the open-front, insulated cabinet 110 of the refrigerated medium temperature merchandiser 100 defines a product display area 125 provided with a plurality of display shelves 130. The evaporator 40 and a plurality of air circulating means, for example axial flow fans, 70 are arranged in cooperative relationship in the compartment 120 of the merchandiser 100, which is connected in an air flow circulation circuit with the product display area via flow ducts 112, 114 and 116 provided in the walls of the insulated cabinet 110. In accordance with one aspect of the present invention, the evaporator 40 comprises a relatively high pressure drop fin and tube heat exchanger coil 42 having a relatively high fin density, that is a fin density at least five fins 44 per inch of tube 46, as compared to the relatively low fin density fin and tube heat exchanger coils commonly used in conventional medium temperature display cases. Due to the relatively high fin density, the pressure drop experienced by circulating air passing through the evaporator coil is significantly higher, typically on the order of 2 to 8 times greater, than the pressure drop experienced under similar flow conditions by circulating air passing through a conventional low fin density fin and tube evaporator coil. This increased flow resistance through the high fin density evaporator coil results in a more uniform air flow distribution through the evaporator. Most advantageously, the relatively high density fin and tube heat exchanger coil 42 of the high efficiency evaporator 40 has a fin density in the range of six to fifteen fins per inch. The relatively high fin density heat exchanger coil 42 is capable of operating at a significantly lower differential of refrigerant temperature to evaporator outlet air temperature than the differential at which conventional low fin density evaporators operate.

In a further aspect of the present invention, the fins 44 may have an enhanced profile rather than being the typical flat plate fins customarily used in prior art commercial refrigerated merchandisers. Advantageously, the fins 44 may comprise corrugated plates disposed with the waves of the plate extending perpendicularly to the direction of air flow through the fin and tube heat exchanger coil 42. Using enhanced configuration fins not only increases heat transfer between the coil and the air, but also increases the pressure drop through the heat exchanger coil 42, thereby further improving the uniformity of air flow distribution through the evaporator.

In accordance with a further aspect of the present invention, the spacing between neighboring fans 70 is reduced to provide a greater number of fans 70 along the length of the high efficiency evaporator 40. Increasing the number of fans further improves air flow distribution uniformity along the length of the evaporator. Most advantageously, the spacing between neighboring fans 70 is reduced to about two feet or less. For example, in accordance with this aspect of the present invention, the refrigerated merchandiser 100 of the present invention in a twelve-foot long embodiment, as best illustrated in FIG. 4, will have six fans spaced apart at two-foot intervals, as opposed to three fans spaced at four-foot intervals as in conventional refrigerated merchandisers. The added flow resistance associated with the relatively high fin density coil of the evaporator 40, coupled with the increased number of fans creates a significantly more uniform velocity profile across the evaporator outlet, results in the formation of the substantially uniform evaporator outlet temperature distribution characteristically associated with the high efficiency evaporator 40 of the present invention.

The pitch of the blades of the axial flow fan may be reduced from conventional pitch angles of 35 degrees to a pitch angle in the range of 25 to 30 degrees. Additionally, it is advantageous to increase the power of the fan motor. For example, on a 12 foot evaporator installation, instead of using three, 9 watt fans having a blade pitch angle of 35 degrees, in accordance with the teachings of the present invention, six, 16 watt fans having a blade pitch angle of 27 degrees may be used.

Figure 5:
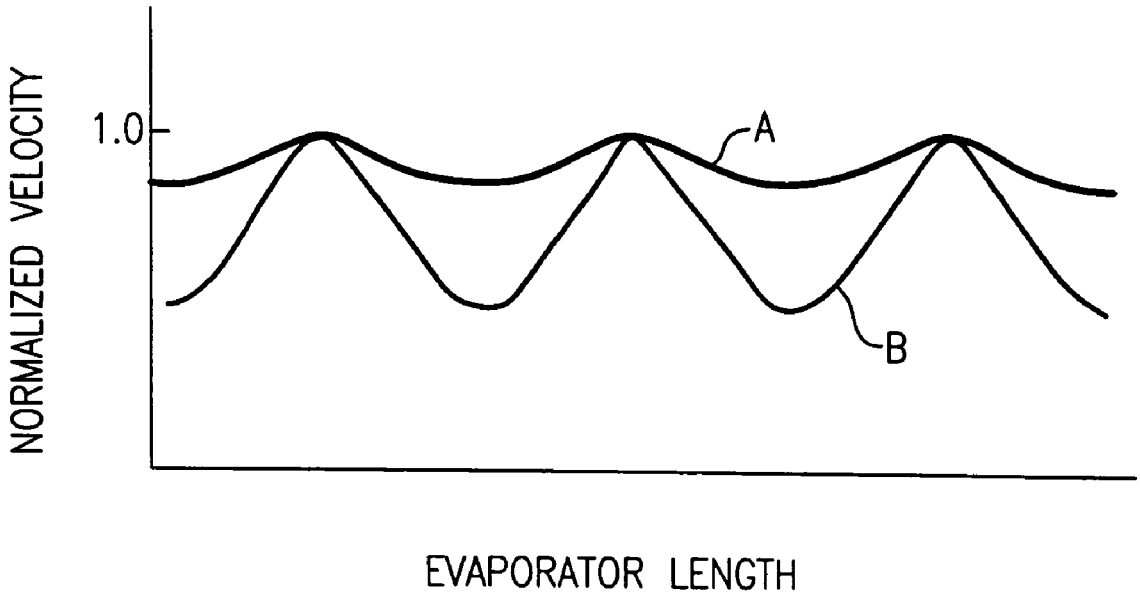
FIG. 5 is a graphical comparison of the air flow velocity profile leaving a relatively high pressure drop evaporator with closely spaced axial flow fans in accordance with the present invention as compared to the air velocity profile leaving a relatively low pressure drop evaporator with conventionally spaced axial flow fans.

Referring now to FIG. 5, Profile A represents the normalized air flow velocity profile leaving the evaporator of a unit equipped with a high fin density evaporator 40 together with a plurality of laterally spaced, axial fans 70 spaced at two-foot intervals extending along the length of the evaporator in accordance with the present invention. Profile B represents the normalized evaporator exit air flow velocity profile characteristic of the conventional prior art arrangement of an low fin density evaporator having a plurality of laterally spaced, axial flow fans associated therewith, those fans spaced at three-foot, rather than two-foot intervals. As illustrated by Profile B, in such a conventional arrangement, the air flow velocity varies substantially across the length of the evaporator. Peak velocities are encountered directly downstream of the axial flow fans and minimum velocities are encountered intermediate each pair of adjacent axial flow fans and at the lateral extremes of the evaporator. With a high pressure drop evaporator and a greater number of more closely spaced fans in accordance with the present invention, a significantly more uniform air flow velocity profile, as designated by Profile A, is attained at the exit of the evaporator.

In the embodiment of the refrigerated merchandiser 100 of the present invention shown in FIGS. 3 and 4, the high efficiency evaporator 40 and the increased number of more closely spaced fans 70 are disposed in a draw through flow arrangement. That is, the fans 70 are disposed downstream with respect to airflow of the evaporator. So arranged, the circulating air is drawn through the evaporator 40 by the fans 70 resulting in a more uniform local velocity distribution in the outlet air flow along the length of the evaporator 40 than attainable in a conventional forced flow arrangement. However, it is to be understood that the high pressure drop evaporator 40 and the fan 70 arrangement is also applicable to an evaporator and fans in a forced draft arrangement such as illustrated in FIG. 2.

As each particular refrigerant has its own characteristic temperature-pressure curve, it is theoretically possible to provide for frost-free operation of the evaporator 40 by setting EPRV 60 at a predetermined minimum pressure set point for the particular refrigerant in use. In this manner, the refrigerant temperature within the evaporator 40 may be effectively maintained at a point at which all external surfaces of the evaporator 40 in contact with the moist air within the refrigerated space are above the frost formation temperature. However, due to structural obstructions or airflow maldistribution over the evaporator coil, some locations on the coil may fall into a frost formation condition leading to the onset of frost formation.

Advantageously, a controller 90 may be provided to regulate the set point pressure at which the EPRV 60 operates. The controller 90 receives an input signal from at least one sensor operatively associated with the evaporator 40 to sense an operating parameter of the evaporator 40 indicative of the temperature at which the refrigerant is boiling within the evaporator 40. The sensor may comprise a pressure transducer 92 mounted on suction line 18 near the outlet 43 of the evaporator 40 and operative to sense the evaporator outlet pressure. The signal 91 from the pressure transducer 92 is indicative of the operating pressure of the refrigerant within the evaporator 40 and therefore, for the given refrigerant being used, is indicative of the temperature at which the refrigerant is boiling within the evaporator 40. Alternatively, the sensor may comprise a temperature sensor 94 mounted on the coil of the evaporator 40 and operative to sense the operating temperature of the outside surface of the evaporator coil. The signal 93 from the temperature sensor 94 is indicative of the operating temperature of the outside surface of the evaporator coil and therefore is also indicative of the temperature at which the refrigerant is boiling within the evaporator 40. Advantageously, both a pressure transducer 92 and a temperature sensor 94 may be installed with input signals being received by the controller 90 from both sensors thereby providing safeguard capability in the event that one of the sensors fails in operation.

The controller 90 determines the actual refrigerant boiling temperature at which the evaporator is operating from the input signal or signals received from sensor 92 and/or sensor 94. After comparing the determined actual refrigerant boiling temperature to the desired operating range for refrigerant boiling temperature, the controller 90 adjusts, as necessary, the set point pressure of the EPRV 60 to maintain the refrigerant boiling temperature at which the evaporator 40 is operating within a desired temperature range.

The refrigerated merchandiser system 10 may be operated in accordance with a particularly advantageous method of operation described in detail in commonly assigned, co-pending U.S. patent application Ser. No. 09/652,353, filed Aug. 31, 2000. In accordance with this method of operation, the controller 90 functions to selectively regulate the set point pressure of the EPRV 60 at a first set point pressure for a first time period and at a second set point pressure for a second time period and to continuously cycle the EPRV 60 between the two set point pressure. The first set point pressure is selected to lie within the range of pressures for the refrigerant in use equivalent at saturation to a refrigerant temperature in the range of 24 degrees F. to 32 degrees F., inclusive. The second set point pressure is selected to lie within the range of pressures for the refrigerant in use equivalent at saturation to a refrigerant temperature in the range of 31 degrees F. to 38 degrees F., inclusive. Therefore, the refrigerant boiling temperature within the evaporator 40 of the medium temperature display case 100 is always maintained at a refrigerating level, cycling between a first temperature within the range of 24 degrees F. to 32 degrees F. for a first time period and a second slightly higher temperature within the range of 31 degrees F. to 38 degrees F. for a second period. In this cyclic mode of operation, the evaporator 40 operates continuously in a refrigeration mode, while any undesirable localized frost formation that might occur during the first period of operation cycle at the cooler refrigerant boiling temperatures is periodically eliminated during second period of the operating cycle at the warmer refrigerant boiling temperatures. Typically, it is advantageous to maintain the refrigerant boiling temperature within the evaporator during the second period of an operation cycle at about 2 to about 12 degrees F. above the refrigerant boiling temperature maintained during the first period of the operation cycle.

Although, the respective duration of the first period and the second period of the operation cycle will varying from display case to display case, in general, the first time period will substantially exceed the second time period in duration. For example, a typical first time period for operation at the relatively cooler refrigerant boiling temperature will extend for about two hours up to several days, while a typical second time period for operation at the relatively warmer refrigerant boiling temperature will extend for about fifteen to forty minutes. However, the operator of the refrigeration system may selectively and independently program the controller 90 for any desired duration for the first time period and any desired duration for second time period without departing from the spirit and scope of the present invention.

In transitioning from operation at the relatively cooler refrigerant boiling temperature to continued refrigeration operation at the relatively warmer refrigerant boiling temperature, it may be advantageous to briefly maintain steady-state operation at an intermediate temperature of about 31 to about 32 degrees F. The time period for operation at this intermediate temperature would generally extend for less than about ten minutes, and typically from about four to about eight minutes. Such an intermediate steady-state stage may be desirable, for example on single compressor refrigeration systems, as a means of avoiding excessive compressor cycling. In sequencing back from operation at the relatively warmer refrigerant boiling temperature to operation at the relatively cooler refrigerant boiling temperature, no intermediate steady-state stage is provided.

Although a preferred embodiment of the present invention has been described and illustrated, other changes will occur to those skilled in the art. It is therefore intended that the scope of the present invention is to be limited only by the scope of the appended claims.

What is claimed is:

1. A medium temperature refrigerated merchandiser system comprising:

an insulated cabinet defining a product display area maintained in a refrigerated condition at a temperature above 32 degrees F. and having a compartment separate from the product display area;

a relatively high air side pressure drop evaporator disposed within said compartment and having a length, wherein the relatively high air side pressure drop for the evaporator is provided at least in part by a fin and tube heat exchanger having a fin density in the range of 6 fins per inch to 15 fins per inch, and having fins comprising corrugated plates having waves that extend perpendicularly to a direction of airflow through the evaporator;

a plurality of air circulators disposed within said compartment and having a spacing therebetween, and in cooperative relationship with said evaporator, wherein the air circulators have blades disposed at a pitch angle within the range of approximately 25 to 30 degrees; and an air circulation circuit connecting said product display area in direct air flow communication with said compartment;

wherein the relatively high air side pressure drop evaporator and the plurality of air circulators with the spacing therebetween are operable to provide a substantially uniform evaporator exit airflow velocity profile along the length of the evaporator.

2. A medium temperature refrigerated merchandiser system as recited in claim 1 wherein said air circulators comprise a plurality of fans and the spacing is about 2 feet.

3. A medium temperature refrigerated merchandiser system as recited in claim 1 wherein said evaporator is disposed in a draw through flow arrangement with respect to said air circulators whereby said air circulators draw circulating air from said product display area through said evaporator.

4. A medium temperature refrigerated merchandiser system comprising:

an insulated cabinet defining a product display area wherein product is maintained in a refrigerated condition at a temperature at or above 32 degrees F. and having a compartment separate from the product display area;

a relatively high air side pressure drop evaporator disposed within said compartment, wherein the relatively high air side pressure drop for the evaporator is provided at least in part by a fin and tube exchanger having a length and a fin density of at least 6 fins per inch, and having fins comprising corrugated plates having waves that extend perpendicularly to a direction of airflow through the evaporator;

a plurality of air circulators disposed within said compartment in cooperative relationship with said evaporator, wherein the air circulators have blades disposed at a pitch angle within the range of approximately 25 to 30 degrees; and an air circulation circuit connecting said product display area in direct air flow communication with said compartment;

wherein the relatively high air side pressure drop evaporator and the plurality of air circulators with the spacing therebetween are operable to provide an evaporator exit airflow velocity profile having a variation of less than approximately 20 percent along the length of the evaporator.

5. A medium temperature refrigerated merchandiser system as recited in claim 4 wherein the air circulators comprise a plurality of fans and the spacing is about 2 feet.

6. A medium temperature refrigerated merchandiser system as recited in claim 4 wherein said evaporator is disposed in a draw through flow arrangement with respect to said air circulators whereby said air circulators draw circulating air from said product display area through said evaporator.

7. A medium temperature refrigerated merchandiser system comprising:

an insulated cabinet defining a product display area wherein product is maintained in a refrigerated condition at a temperature at or above 32 degrees F. and having a compartment separate from the product display area;

a relatively high air side pressure drop evaporator disposed within said compartment, wherein the relatively high air side pressure drop for the evaporator is provided at least in part by a fin and tube exchanger having a length and a fin density in the range of 6 fins per inch to 15 fins per inch, and having fins comprising corrugated plates having waves that extend perpendicularly to a direction of airflow through the evaporator;

a plurality of air circulators disposed within said compartment in cooperative relationship with said evaporator, wherein the air circulators have blades disposed at a pitch angle within the range of approximately 25 to 30 degrees; and an air circulation circuit connecting said product display area in direct air flow communication with said compartment;

wherein the relatively high air side pressure drop evaporator and the plurality of air circulators with the spacing therebetween are operable to provide an evaporator exit airflow velocity profile having a variation of less than approximately 20 percent along the length of the evaporator.

8. A medium temperature refrigerated merchandiser system as recited in claim 7 wherein said fins of said evaporator have an enhanced heat transfer configuration.

9. A medium temperature refrigerated merchandiser system as recited in claim 7 wherein said air circulators comprise a plurality of fans and the spacing is about 2 feet.

10. A medium temperature refrigerated merchandiser system as recited in claim 7 wherein said evaporator is disposed in a draw through flow arrangement with respect to said air circulators whereby said air circulators draw circulating air from said product display area through said evaporator.

* * * * *